US006510982B2

(12) United States Patent
White et al.

(10) Patent No.: US 6,510,982 B2
(45) Date of Patent: Jan. 28, 2003

(54) SHIPPER AND DISPLAY CARTON

(75) Inventors: Charles Raymond White, Parsippany, NJ (US); Leonard Beer, Pleasantmount, PA (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/876,695

(22) Filed: Jun. 7, 2001

(65) Prior Publication Data

US 2002/0043554 A1 Apr. 18, 2002

Related U.S. Application Data

(60) Provisional application No. 60/211,496, filed on Jun. 14, 2000.

(51) Int. Cl.[7] ..... B65D 5/54; B65D 17/28

(52) U.S. Cl. ..... 229/235; 206/736; 229/164; 229/241; 229/242; 229/925

(58) Field of Search ..... 229/164, 235, 229/240, 241, 242, 925; 206/736, 774, 806

(56) References Cited

U.S. PATENT DOCUMENTS 3,166,229 A * 1/1965 Sherman et al. ..... 229/242
3,543,998 A * 12/1970 Dunlap ..... 229/241
3,917,158 A * 11/1975 Dorofachuk et al. ..... 229/241
4,000,811 A * 1/1977 Hardison et al. ..... 229/242
4,058,206 A * 11/1977 Morse et al. ..... 229/241
4,213,559 A * 7/1980 Meyers ..... 206/806
4,350,281 A * 9/1982 Dornbusch et al. ..... 206/774
4,363,400 A * 12/1982 Lewis ..... 229/240
4,553,666 A * 11/1985 Gullikson ..... 229/235
5,213,255 A * 5/1993 Cote ..... 229/925

FOREIGN PATENT DOCUMENTS

FR 2620682 A3 * 3/1989 ..... 229/240

* cited by examiner

*Primary Examiner*—Gary E. Elkins
(74) *Attorney, Agent, or Firm*—Michael J. McGreal

(57) ABSTRACT

There is described a shipper/display carton that has high structural integrity as a shipper carton, is easy opening, and is functional as a display carton. The carton comprises a front panel with a weakened area near a bottom edge, two side panels, each having a weakened area extending substantially diagonally across the sidewall, and a weakened area across a top edge of the rear wall. Additionally, there can be a further weakened region where the rear panel weakened area intersects the weakened areas of the side panels. There is a grip aperture in the rear wall. Due to the placement and structure of the weakened areas, the carton with these weakened areas is sufficiently strong to function as a shipper carton.

15 Claims, 3 Drawing Sheets

SHIPPER AND DISPLAY CARTON

This application claims the benefit of Provisional Application No. 60/211,496, filed Jun. 14, 2000.

FIELD OF THE INVENTION

This invention relates to a carton that can be used to ship products to the point of sale, and when at the point of sale can be use to hold and display the products. More particularly, this invention relates to a carton which can be easily opened and when opened, can be used to attractively display the contents of the carton.

BACKGROUND OF THE INVENTION

Most goods are shipped to the point of sale using a shipping carton. Such a carton holds the product or products firmly in place and prevents the products from being damaged during shipping. At the point of sale such cartons are cut open and the product contents placed on a shelf for display and sale. This includes the manual removing of each product item from the carton and placing it on the shelf. The shipping carton then is crushed and set for disposal, usually where the corrugate of the carton is recycled. This manual removing of each item from a carton is time consuming. It is preferred to have a carton which also can be used to display the items on a shelf. Then a carton with one or more dozen units of products can be put onto the shelf in one operation. This savings in time results in a direct reduction in costs.

A combined display and shipping carton can be very useful. However, it must function well in several areas. It must be sufficiently strong to protect the products being shipped during shipping and handling. It must be easily openable, and must open in the same way every time. And after being opened, it must be attractive and hold the units of products so that they do not fall over or out of the carton when consumers are removing units of the products for purchase. The same carton must meet the shipping requirements and the display requirements.

The present shipper/display carton solves the problem of a convenient shipping and display carton for products such as cosmetics, toiletries, baby care products, liquid soaps, shampoos, household cleaners and polishes, auto care products, pet care products and many others. This is a wide range of goods where the products are packaged from about a dozen up to about four dozen units into a carton. The size of the individual containers will dictate the number of units in a shipper carton. This shipper/display carton provides good protection during shipping, is easy opening, opens in a consistent manner, has a good shelf appearance, and holds the products in a neat array on the shelf at the point of sale.

BRIEF SUMMARY OF THE INVENTION

The present shipper/display carton is directed for use with a plurality of bottles, dispensers, applicators and such products that usually are stacked on shelves in supermarkets, drugstores, discounts stores and price clubs. It precludes having to individually remove each item from a carton and to place it individually onto a shelf.

The shipper and display carton is comprised of a front panel, a rear panel, and two side panels, each connecting the front and rear panels. Each of these panels will have closure flaps. There also will be a glue flap appended to one of the panels. This structure makes the carton a shipper carton.

In order to make it a display carton, part of the carton is made removable. This is accomplished by a weakened area across the lower end of the front panel, then substantially diagonally across each side panel, and across a top area of the rear panel. In a preferred mode the substantially diagonal weakened area of the side panel adjacent the weakened area of the rear panel is substantially weaker than the remaining parts of the weakened area, and in a most preferred embodiment, is a slit or an opening. The rear panel further in a preferred mode will have the weakened area across a top edge and a grip aperture to be used when opening the shipper carton and to convert it to a display carton.

The carton is opened by gripping the rear panel grip aperture and pulling upward to remove the rear panel upward to remove the rear panel top flap, a substantial portion of each side panel and the front panel, and the top flaps associated with each sidewall and the front wall. This removes a substantial portion of the shipper carton converting it into a display carton.

DETAILED DESCRIPTION OF THE DRAWINGS

The shipper/display carton now will be described in more detail and in more preferred embodiments with reference to the drawings.

Figure 1:
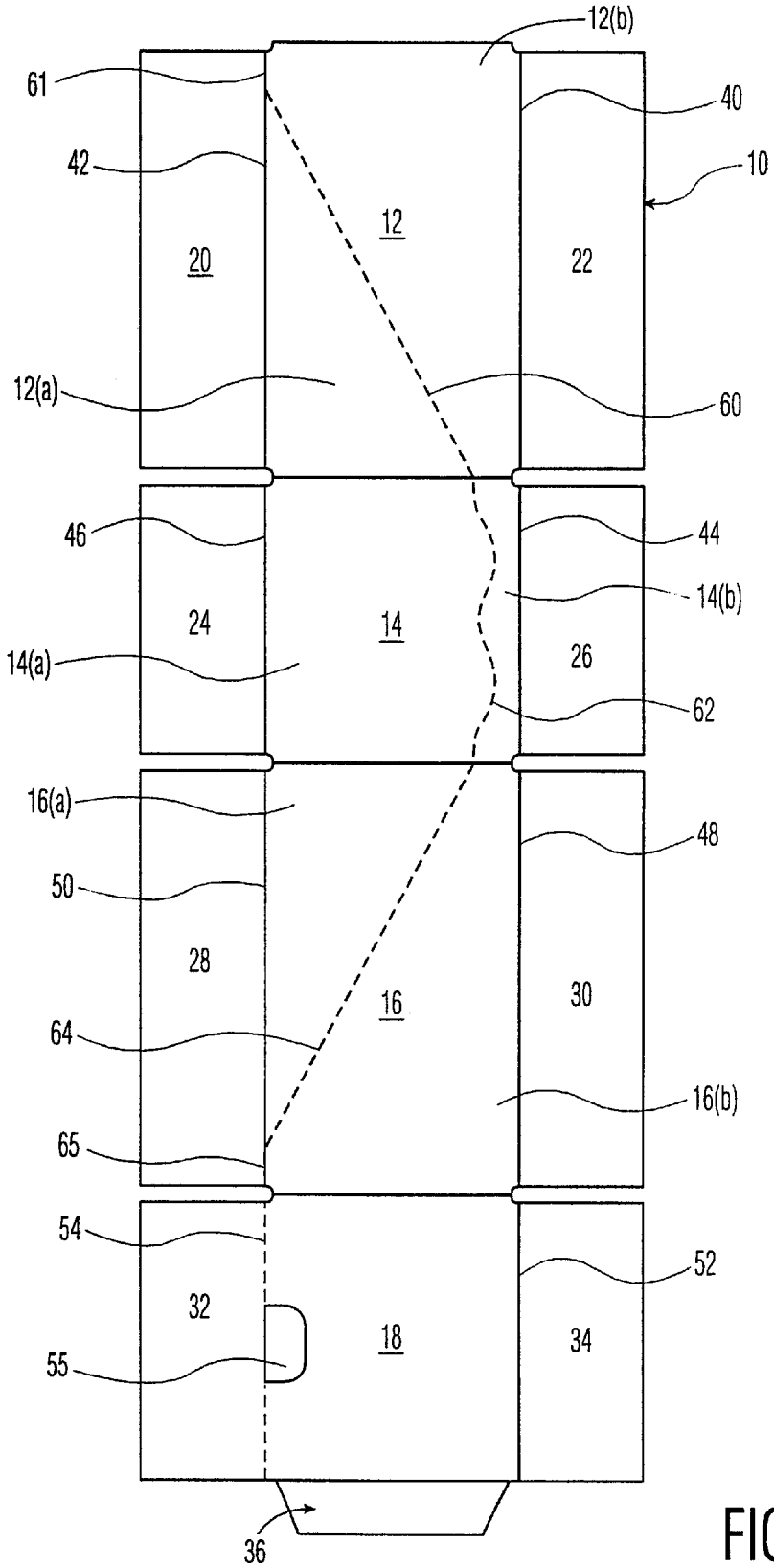
FIG. 1 is a plan view of the carton blank for the shipper/display carton.

FIG. 1 shows a carton blank 10 to make the present shipper/display carton. The carton blank has a first side panel 12, which is attached to front panel 14 which in turn is attached to second side panel 16 which in turn is attached to the rear panel 18. Each of these panels is attached to the other by a hinged joint about which a panel can rotate with regard to a connected panel. Attached to the major edges of first side panel 12 is first side panel top flap 20 and first side panel bottom flap 22. These flaps hingedly bend at joints 42 and 40 respectively.

The first panel has front panel top flap 24 and front panel bottom flap 26 connected through hinge joints 46 and 44 respectively. The second side flap 16 has second side panel top flap 28 and second side panel bottom flap 30 attached by means of hinged joints 50 and 48 respectively.

The rear panel has the glue panel 36 attached at one end, a rear panel top flap 32 and a rear panel bottom flap 34. These two latter flaps are attached to the rear panel by means of hinged joints 54 and 52. Also, a part of the rear panel is grip aperture 55.

The carton blank has a weakened area substantially across each panel. The weakened area 62 across the front panel is a lower part of the front pane. This weakened area is shown as sinusoidal for decorative purposes but can be of essentially shape. A major portion 14(*a*) of this panel is removed with a minor portion 14(*b*) remaining as a part of the display carton. A major portion 12(*a*) of the first side portion also is removed with portion 12(*b*) remaining as part of the display carton. Likewise, a major portion 16(*a*) of the second side panel 16 is removed with portion 16(*b*) remaining as part of the display carton.

The rear panel 18 is shown with no part removed since the weakened area 54 extends across the top edge of this rear panel. However, this weakened area 54 can be designed to be located more within rear panel 18. This would necessitate the realignment of weakened areas 60 and 64 of the side panels.

The present placement of weakened areas is shown as one preferred embodiment and provides for a stronger shipper carton with the rear panel functioning as a wall with no weakened points.

Figure 4:
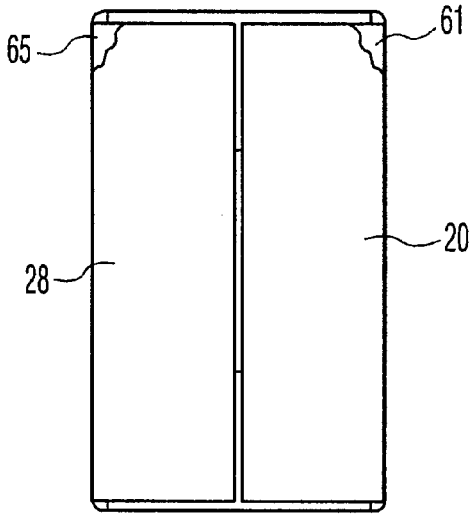
FIG. 4 is a top plan view of the carton constructed from the carton blank of FIG. 1.

The area 65 of weakened area 64 and area 61 of weakened area 60 are further weakened areas, and in a most preferred embodiment, are slits or sections of removed material. In FIG. 4 it is shown as a triangular section of removed material from flaps 20 and 28.

The weakened areas are formed by a series of perorations, serrations and/or slits. They must be sufficient to weaken the material so that when a pulling force is applied the carton will sever along the weakened area. However, the weakened area must be sufficiently strong so as to maintain the integrity of the carton during shipping.

Figure 2:
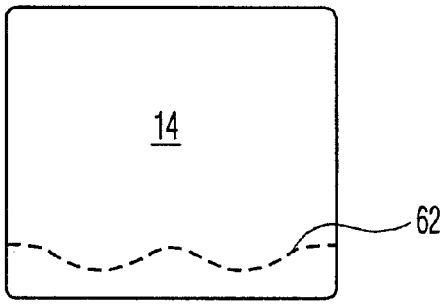
FIG. 2 is a front elevational view of the carton constructed from the carton blank of FIG. 1.
Figure 3:
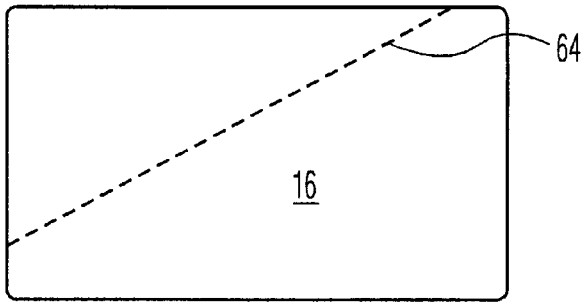
FIG. 3 is a side elevational view of the carton constructed from the carton blank of FIG. 1.

FIG. 2 shows a front view of the sealed carton while FIG. 3 shows a side view. Each side has the same structure. FIG. 4 is a top plan view with the further weakened areas 61 an 65 shown as triangular openings.

Figure 5:
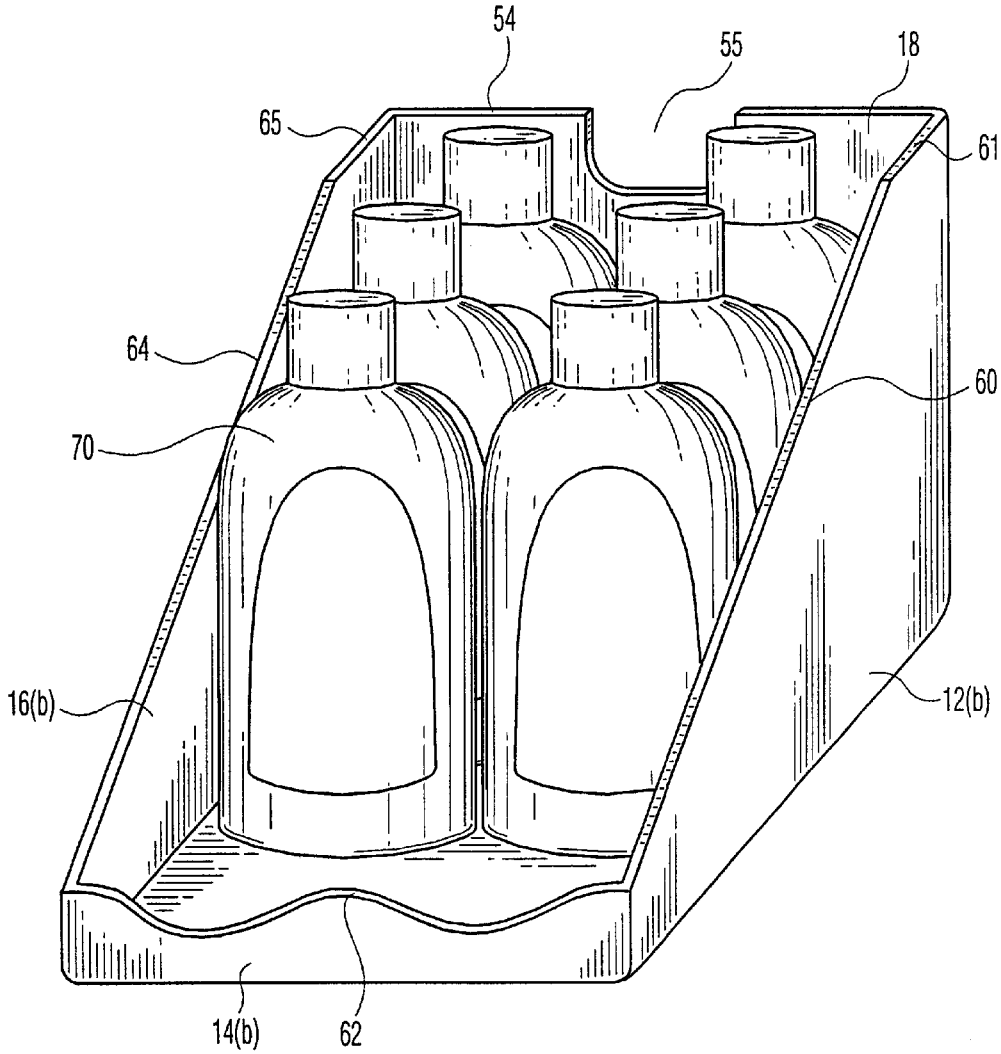
FIG. 5 is the carton of FIGS. 2–4 opened and used as a display carton.

FIG. 5 shows the carton opened and functioning as a display carton. This was opened by putting several fingers through opening 55 and pulling upward. This severed weakened area 54, followed by weakened areas 60 and 64 and the weakened area 62. The result is that a substantial portion of the carton has been removed and the carton converted to a display carton. The full display carton with product containers 70 is placed on the shelf with purchasers removing the containers 70 from the display carton.

The cartons are typically made of a paperboard or corrugate board. Corrugate board provides good strength per unit weight. The flaps of the carton usually are sealed using conventional hot melt adhesives.

The shipper/display carton can be of essentially any size or shape. The concept is a layout for weakened areas to provide for a strong shipper carton, easy conversion to a display carton, and highly functional as a display carton.

What is claimed is:

1. A shipper/display carton comprising a front panel, two side panels and a rear panel, each of the front panel, rear panel and side panels having two flaps attached thereto at edges not attached to another panel, a weakened area across a lower part of said front panel and extending therefrom diagonally upwardly across each of said side panels, and reaching the top of each side panel at a point a spaced distance from the intersection of said side panels and said rear panel, said weakened area being further weakened from said point a spaced distance from the intersection of said side panels and said rear panel to said rear panel.

2. A shipper/display carton as in claim 1 wherein said rear panel has a glue flap on an edge thereof opposite an edge attached to one of said two side panels.

3. A shipper/display as in claim 1 wherein said rear panel has a grip opening opening adjacent an upper edge thereof whereby an upper part of the carton can be removed therefrom.

4. A shipper/display carton as in claim 1 wherein between said point that is a spaced distance from the intersection of said side panels and said rear panel to said rear panel, there is a slit separating said side panels from said top panel.

5. A shipper /display carton as in claim 1 wherein between said point that is a spaced distance from the intersection of said side panels and said rear panel to said rear panel, there is a gap separating said side panels from said top panel.

6. A shipper/display carton as in claim 1 wherein the carton contains a plurality of containers.

7. A shipper/display carton as in claim 1 wherein the weakened area across a lower part of said front panel is sinusoidal in shape.

8. A shipper/display carton as in claim 1 wherein said weakened area is comprised of one of a plurality of serrations, perforations and slits.

9. A carton blank having in a contiguous relationship a front panel, a first side panel, a rear panel, and a second side panel, each panel being hingedly attached to an adjacent panel, each of said front panel, rear panel, first side panel and second side panel having a flap attached to a free edge thereof, said front panel having a weakened area, said weakened area extending substantially diagonally across said first side panel and said second side panel, and extending to a point a spaced distance from the intersection of said side panels and said rear panel, said weakened area from said point a spaced distance from the intersection of said side panels and said rear panel to said rear panel being further weakened.

10. A carton blank as in claim 9 wherein said rear panel has an aperture adjacent an upper edge thereof.

11. A carton blank as in claim 9 wherein said rear panel has a glue panel hingedly attached at an edge of said rear panel opposite the attachment to said second side panel.

12. A carton blank as in claim 9 wherein said weakened area is comprised of one of a plurality of serrations, perforations and slits.

13. A carton blank as in claim 9 wherein said first side panel and said second side panel are separated from said adjaent top panel from said point a spaced distance from the intersection of said side panels and said rear panel to said rear panel.

14. A carton blank as in claim 13 wherein said first and second side panels are separated from said adjacent top panel by a slit.

15. A carton blank as in claim 13 wherein said first and second side panels are separated from said adjacent top panel by a gap.

* * * * *